US006408456B1

(12) United States Patent
Fike et al.

(10) Patent No.: US 6,408,456 B1
(45) Date of Patent: Jun. 25, 2002

(54) SWIVEL TUB AND SHOWER CHAIR SYSTEM

(76) Inventors: Kathleen A. Fike; Gilmour J. Fike, both of 3120 Property La., Valrico, FL (US) 33594

( * ) Notice: Subject to any disclaimer, the term of this patent is extended or adjusted under 35 U.S.C. 154(b) by 0 days.

(21) Appl. No.: 09/923,905

(22) Filed: Aug. 7, 2001

(51) Int. Cl.[7] ..... A47K 3/12
(52) U.S. Cl. ..... 4/560.1; 4/579; 4/611
(58) Field of Search ..... 4/560.1, 578.1, 4/579, 611

(56) References Cited

U.S. PATENT DOCUMENTS 982,626 A * 1/1911 Netschert ..... 4/579
3,902,200 A * 9/1975 Pratt ..... 4/579
4,809,368 A * 3/1989 Johansson ..... 4/579 X
4,951,328 A * 8/1990 Potvin ..... 4/560.1

* cited by examiner

*Primary Examiner*—Robert M. Fetsuga

(57) ABSTRACT

A swivel tub and shower chair system comprising a base assembly having a pedestal in a hollow cylindrical configuration with an upper and lower end and with a plurality of radially positioned stabilizing legs having interior ends rigidly coupled to the lower end of the pedestal; and a chair assembly having a seat with an access aperture and with an imperforate floor there beneath, and with a pair of vertical side extensions coupling the floor and the seat thereby forming a front opening and a rear opening, the floor further having a lower post extending downwardly therefrom and being adapted to be received in the upper end of the pedestal of the base assembly, the chair being offset forwardly from the center of the base assembly.

6 Claims, 4 Drawing Sheets

SWIVEL TUB AND SHOWER CHAIR SYSTEM

BACKGROUND OF THE INVENTION

1. Field of the Invention

The present invention relates to a swivel tub and shower chair system and more particularly pertains to facilitating the cleaning of a physically handicapped person or invalid.

2. Description of the Prior Art

The use of devices to assist in the cleaning of invalids is known in the prior art. More specifically, devices to assist in the cleaning of invalids previously devised and utilized for the purpose of facilitating the cleaning of people with physical handicaps through known methods and apparatuses are known to consist basically of familiar, expected, and obvious structural configurations, notwithstanding the myriad of designs encompassed by the crowded prior art which has been developed for the fulfillment of countless objectives and requirements.

In this respect, the swivel tub and shower chair system according to the present invention substantially departs from the conventional concepts and designs of the prior art, and in doing so provides an apparatus primarily developed for the purpose of facilitating the cleaning of physically handicapped persons or invalids and for relieving the stress and strain on caregivers.

The shower and bathtub benches, chairs and stools on the markets for helping handicapped people take a shower are lacking in the following ways:

1. A safe way for a person that has limited use of legs and arms to be assisted in getting over the bathtub wall and into the bathtub and back out again after the shower is finished.
2. Many do not have arms and a back to help steady a person by providing something to hold on to.
3. Most do not have a hygiene access to facilitate washing personal parts of the body.
4. The benches, stools and chairs available do not provide an easy and safe way to move a person needing to be assisted by a caregiver into and out of a bathtub or shower. When sitting a patient on a transfer bench, the caregiver has to lift patients little by little across said bench until the patient is inside the bathtub if the patient is unable to lift their weight. Sometimes it is a process of lifting, scooting and dragging the patient across the bench and then reversing the process to get the patient out of the bathtub or shower.
5. Some patients have very delicate skin therefore, scooting on or being dragged across a bench by a caregiver there is a chance of tearing the skin on the buttock.
6. When a caregiver has to lift and drag a patient across a transfer bench there is always a chance caregiver will be injured by straining their back, injuring a vertebra, or getting nerves pinched.
7. Patient lacks complete support during the entire process of getting into and out of the bathtub or shower. The patient that is week in their legs are in danger of falling, even while being helped by a caregiver. This also puts the caregiver at risk as described in sections 4, 5 and 6, above Therefore, it can be appreciated that there exists a continuing need for a new and improved swivel tub and shower chair system which can be used for facilitating the cleaning of physically handicapped persons or invalids and for relieving the stress and strain on caregivers. In this regard, the present invention substantially fulfills this need.

SUMMARY OF THE INVENTION

In view of the foregoing disadvantages inherent in the known types of devices to assist in the cleaning of invalids now present in the prior art, the present invention provides an improved swivel tub and shower chair systems. As such, the general purpose of the present invention, which will be described subsequently in greater detail, is to provide a new and improved swivel tub and shower chair systems which has all the advantages of the prior art and none of the disadvantages.

To attain this, the present invention essentially comprises a swivel tub and shower chair system with an oval hygiene access to facilitate the cleaning of physically handicapped persons or invalids and for relieving the stress and strain on caregivers. The system comprises, in combination, a bathing assembly positionable adjacent to a room wall and having a bath tub. The bath tub has a horizontal bottom at its lower extent and an upwardly extending interior wall adapted to abut the room wall and an upwardly extending exterior wall parallel with and laterally spaced with respect to the interior wall. The exterior wall terminates at an upper horizontal edge about 12 inches higher than the horizontal bottom of the bath tub. The system also includes a plastic base assembly having a vertically disposed support pedestal in a hollow cylindrical configuration with a diameter of about 2 inches and having an upper end and a lower end. The base assembly further has four radially positioned stabilizing legs in a cross-like configuration 90 degrees from each other. Each leg is about 12 inches in length formed in a cylindrical configuration with an interior end rigidly coupled to the exterior of the lower end of the pedestal and a second end receiving a nonskid rubber cap to prevent slippage of the base assembly as well as to prevent marring of the bottom of the tub. The base assembly is adapted to rest on the bottom of the tub with the pedestal and legs being sized such that they fit between the interior and exterior walls of the tub. The system further includes a plastic chair assembly having a horizontal seat with an oval hygiene access aperture located there through providing increased access to a bather's private areas to be cleaned. The seat has an upper face, lower face, front edge, rear edge and a pair of side edges there between. The seat further has a contoured back having a top edge and a lower edge. The back has a plurality of radially spaced generally rectangular slots. The chair assembly also has a pair of arm rests coupled between the top edge of the back region and the side edges of the seat region in proximity of the front edge forming a forward portion whereby the front edge extends forwardly past arm rests. The aperture is spaced closer to the front edge of the seat than the rear edge. The chair assembly also has an angled imperforate floor with an upper face and lower face and a pair of vertical side extensions coupling the floor and the seat at their sides. The floor and the seat and the side extensions there by form a front opening and a rear opening with the front opening beneath the front edge of the seat for venting water. The chair assembly further has a coned region with an enlarged upper end coupled to the lower side of the floor and a lower post extending downwardly from the lower tapered end and being adapted to be received in the upper end of the hollow support pedestal of the base assembly. The chair assembly is offset forwardly from the center of the base assembly so when the chair is rotated, the front edge of the seat extends over the exterior wall of the tub. Lastly, the system includes a cylindrical bearing positionable upon the upper end of the pedestal and adapted to receive the post to facilitate the rotational movement of the seat with respect to the base assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved swivel tub and shower chair systems which has all of the advantages of the prior art devices to assist in the cleaning of invalids and none of the disadvantages.

It is another object of the present invention to provide a new and improved swivel tub and shower chair systems which may be easily and efficiently manufactured and marketed.

It is further object of the present invention to provide a new and improved swivel tub and shower chair systems which is of durable and reliable constructions.

An even further object of the present invention is to provide a new and improved swivel tub and shower chair systems which is susceptible of a low cost of manufacture with regard to both materials and labor, and which accordingly is then susceptible of low prices of sale to the consuming public, thereby making such swivel tub and shower chair systems economically available to the buying public.

Even still another object of the present invention is to provide a swivel tub and shower chair system for facilitating the cleaning of physically handicapped persons or invalids and for relieving the stress and strain on caregivers.

Lastly, it is an object of the present invention to provide a new and improved swivel tub and shower chair system comprising a base assembly having a pedestal in a hollow cylindrical configuration with an upper and lower end and with a plurality of radially positioned stabilizing legs having interior ends rigidly coupled to the lower end of the pedestal; and a chair assembly having a seat with an access aperture and with an imperforate floor there beneath, and with a pair of vertical side extensions coupling the floor and the seat thereby forming a front opening and a rear opening, the floor further having a lower post extending downwardly therefrom and being adapted to be received in the upper end of the pedestal of the base assembly, the chair being offset forwardly from the center of the base assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
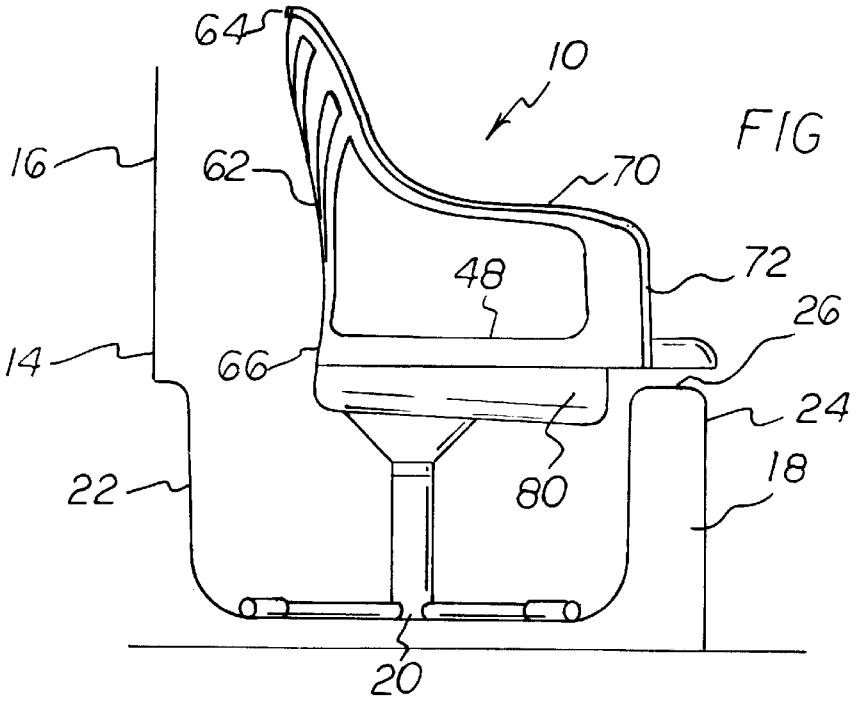
FIG. 1 is a side perspective view of the swivel tub and shower chair system constructed in accordance with the preferred embodiment of the present invention.
Figure 2:
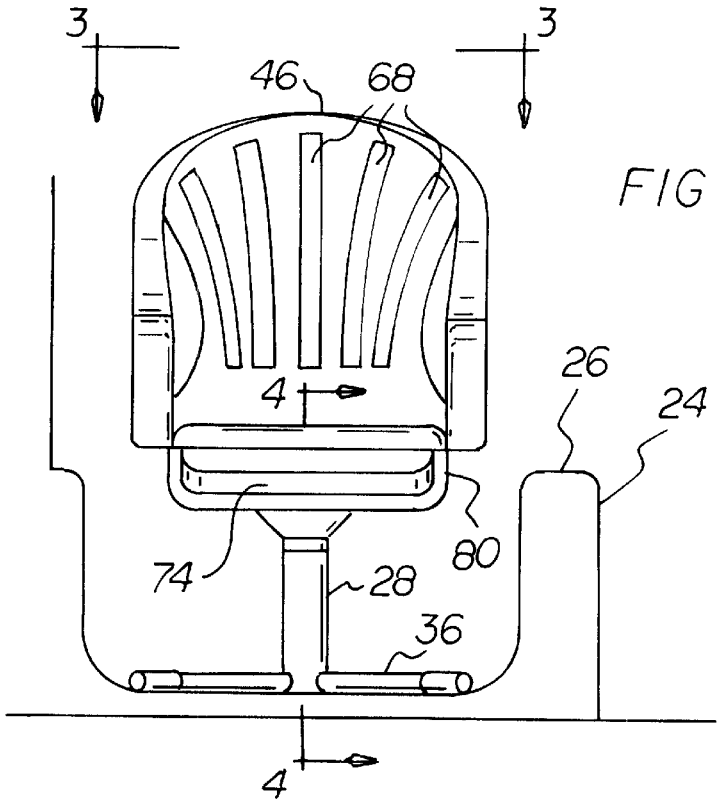
FIG. 2 is a front perspective view of the system shown in FIG. 1.
Figure 3:
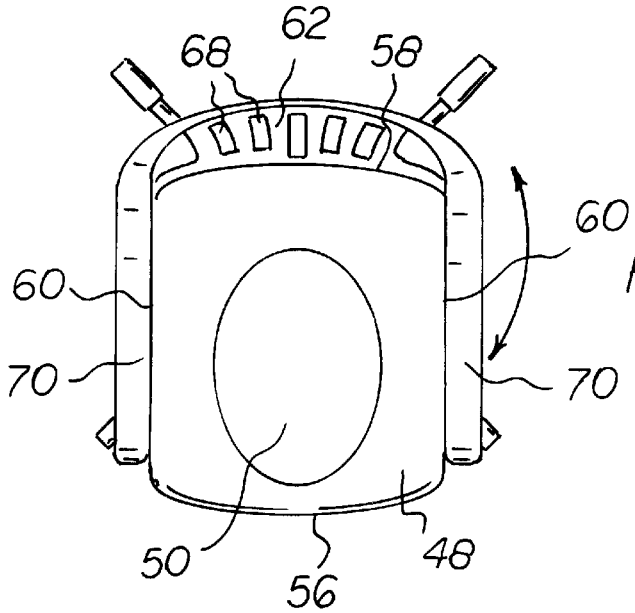
FIG. 3 is a top plan view of the system taken along line 3—3 of FIG. 2.
Figure 4:
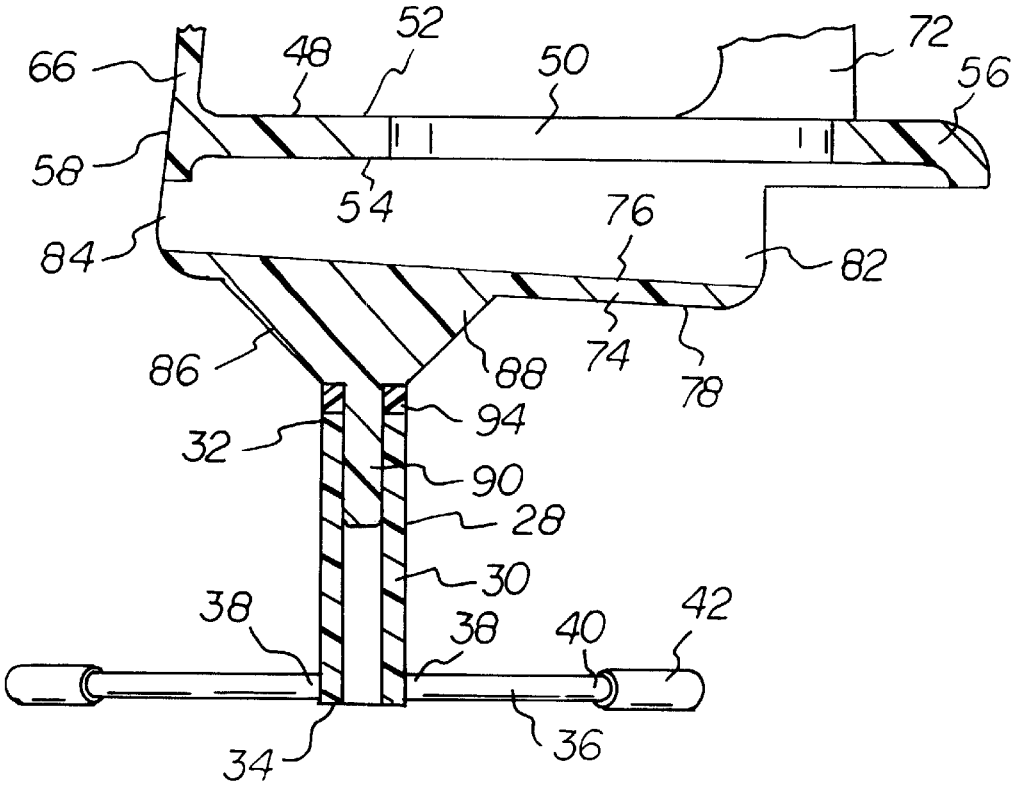
FIG. 4 is a cross sectional view of the system taken along line 4—4 of FIG. 2.

With reference now to the drawings, and in particular to FIG. 1 thereof, the preferred embodiment of the new and improved swivel tub and shower chair systems embodying the principles and concepts of the present invention and generally designated by the reference numeral 10 will be described.

The present invention, the swivel tub and shower chair systems 10 is comprised of a plurality of components. Such components in their broadest context include a bathing assembly, a base assembly, a chair assembly and a bearing. Such components are individually configured and correlated with respect to each other so as to attain the desired objective.

The present invention is a swivel tub and shower chair system 10 with an oval hygiene access area. The access area is to facilitate the cleaning of a physically handicapped person or invalid and for relieving the stress and strain on caregivers. The system includes a bathing assembly 14. The bathing assembly is positionable adjacent to a room wall 16. It includes a bath tub 18. The bath tub has a horizontal bottom 20 at its lower extent and an upwardly extending interior wall 22 adapted to abut the room wall. It also has an upwardly extending exterior wall 24 parallel with and laterally spaced with respect to the interior wall. The exterior wall terminates at an upper horizontal edge 26 about 12 inches higher than the horizontal bottom of the bath tub.

The second assembly of the system is a plastic base assembly 28. Such assembly has a vertically disposed support pedestal 30 in a hollow cylindrical configuration with a diameter of about 2 inches. The pedestal has an upper end 32 and a lower end 34. The base assembly further has four radially positioned stabilizing legs 36 in a cross-like configuration, 90 degrees from each other. Each leg is about 12 inches in length formed in a cylindrical configuration with an interior end 38 rigidly coupled to the exterior of the lower end of the pedestal and a second end 40 receiving a nonskid rubber cap 42. The caps are to prevent slippage of the base assembly as well as to prevent marring of the bottom of the tub. The base assembly is adapted to rest flatly on the bottom of the tub with the pedestal and legs being sized such that they fit between the interior and exterior walls of the tub. The base assembly is also adapted to rest on the bottom of a shower.

The third assembly of the system is plastic chair assembly 46. The chair assembly includes a horizontal seat 48 with an oval hygiene access aperture 50. The aperture is located through the seat for providing increased access to a bather's private areas to be cleaned. The seat has an upper face 52, lower face 54, front edge 56, rear edge 58 and a pair of side edges 60 there between. The seat further has a contoured back 62 having a top edge 64 and a lower edge 66. The back has a plurality of radially spaced generally rectangular slots 68. The chair assembly also has a pair of arm rests 70 coupled between the top edge of the back region and the side edges of the seat region in proximity of the front edge. There is thus formed a forward portion 72 whereby the front edge extends forwardly past arm rests. The aperture is spaced closer to the front edge of the seat than the rear edge. The chair assembly also has a horizontal imperforate floor 74 with an upper face 76 and lower face 78. A pair of vertical side extensions 80 couple the floor and the seat at their sides. The floor and the seat and the side extensions there by form a front opening 82 and a rear opening 84 with the front opening beneath the front edge of the seat for venting water.

The chair assembly further has a coned region 86 with an enlarged upper end 88 coupled to the lower side of the floor. A lower post 90 extends downwardly from the lower tapered end and is adapted to be received in the upper end of the hollow support pedestal of the base assembly. The chair assembly is offset forwardly from the center of the base assembly so when the chair is rotated, the front edge of the seat extends over the exterior wall of the tub.

Lastly provided is a plastic cylindrical bearing 94. Such bearing is positionable upon the upper end of the pedestal. It is adapted to receive the post to facilitate the rotational movement of the seat with respect to the base assembly.

Figure 5:
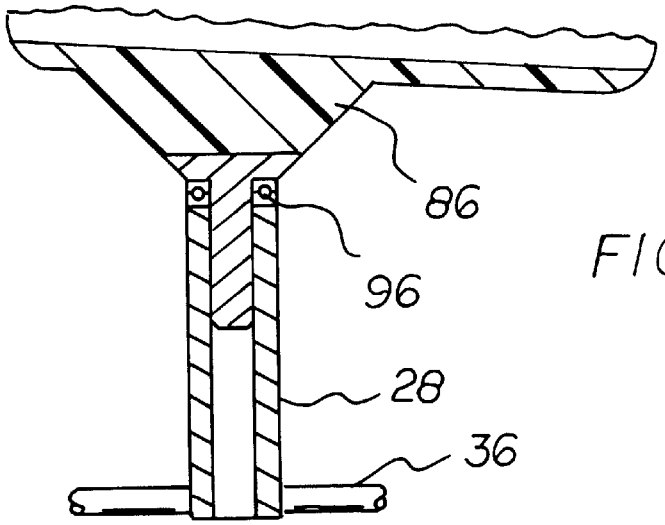
FIG. 5 is a cross sectional view showing the base assembly and lower assemblies of the chair assembly illustrating an alternative embodiment of the present invention.

In an alternate embodiment of the invention, as can be seen in FIG. 5, the plastic bearing is replaced by a cylindrical ball bearing race 96 fabricated of stainless steel. Such ball bearing race is positionable upon the upper end of the pedestal. It is adapted to receive the post to facilitate the rotational movement of the chair assembly with respect to the base assembly. In this embodiment, the pedestal and post are also fabricated of stainless steel.

Figure 6:
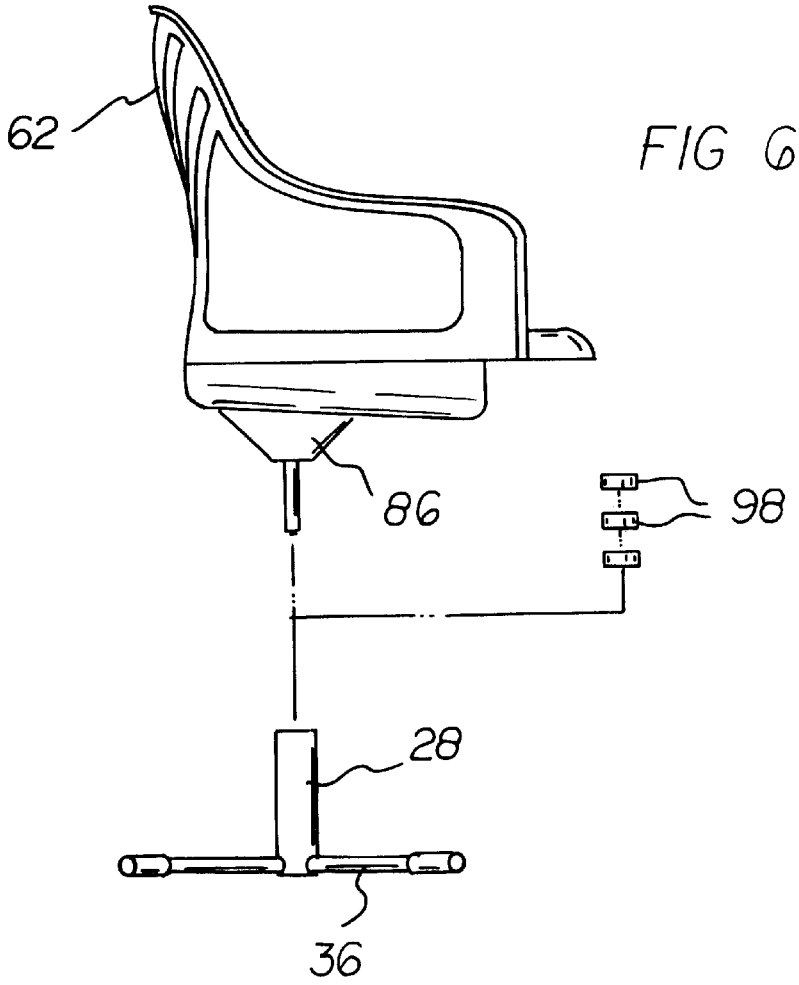
FIG. 6 is an exploded view of another alternative embodiment of the present invention.

A further alternate embodiment of the invention can be seen in FIG. 6. In such embodiment, a plurality of cylindrical spacers 98 are provided. Such spacers are fabricated of plastic. They are positionable upon the upper end of the pedestal and are adapted to receive the post to facilitate varying the elevational height of the chair assembly with respect to the base assembly as a function of the number of spacers utilized. The spacers also function as bearings as in the primary embodiment.

Figure 7:
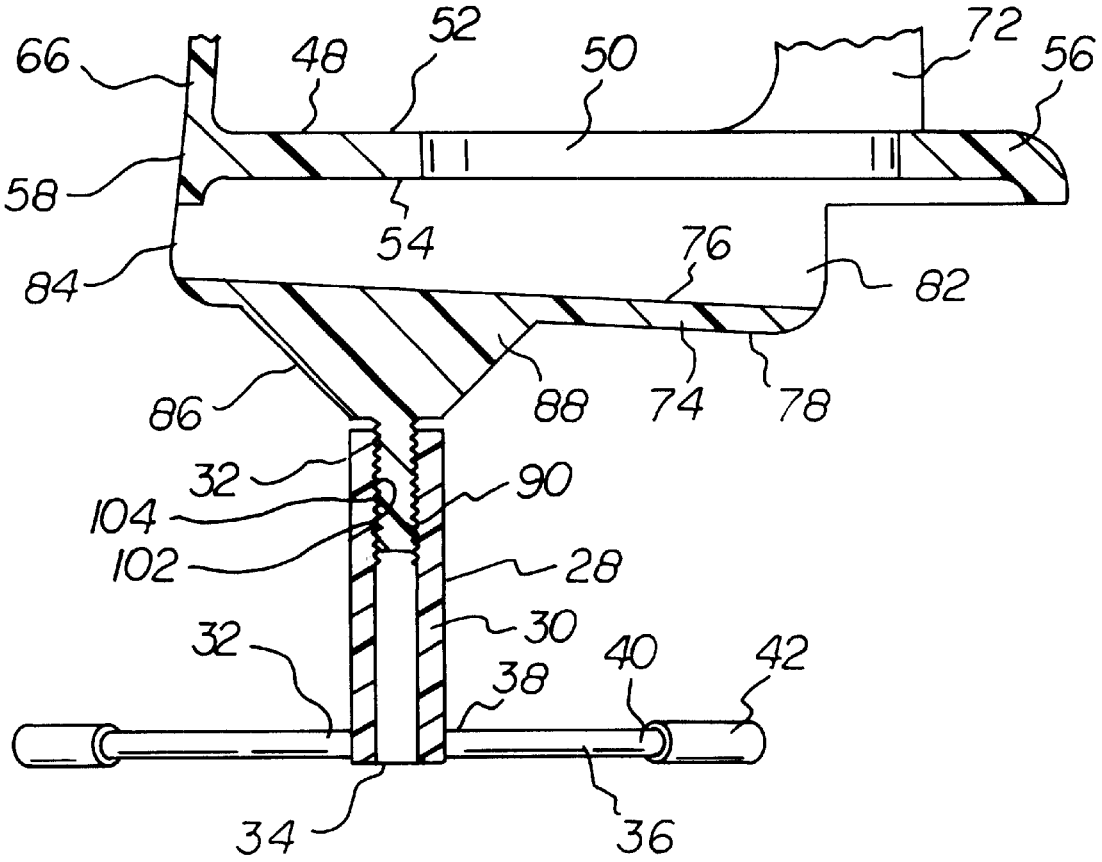
FIG. 7 is a cross sectional view similar to FIG. 4 but illustrating another alternate embodiment of the invention.

FIG. 7 is the final alternate embodiment of the invention. In such embodiment, the pedestal and the post are both fabricated to include screw threads 102, 104. Rotation of the post 90 with its threads 102 within the within the pedestal 30 with its fixed threads 104 will rotate the seat and also cause the raising and/or lowering of the seat.

As can be understood from the above description, the swivel bath chair of the present invention is adapted to sit on a stationary base in the bottom of the bathtub or shower. The seat of the chair has arms and a back connecting to it. Located approximately in the center of the seat is an oval hygiene access hole. The seat structure has been offset from the center of the base so when it is rotated the front edge of the seat extends over the inside edge of the bathtub wall or the shower curb.

If a person is fearful of falling while stepping over the bathtub wall the swivel bath shower chair can be place into the tub, rotated so the edge of the seat extends over the inside edge of the tub, then sit in the seat rotating it while lifting one foot at a time over the bathtub wall or the shower curb. When shower is finished the person can reverse the process and be safely and easily out of the tub or shower.

If a patient is in a wheelchair the wheelchair can be pushed to the edge of the bathtub or shower. Then the swivel bath shower chair can be rotated so the edge of the seat extends over the inside edge of the bathtub wall or the shower curb. The caregiver can then assist the person to stand from the wheelchair and sit into the swivel bath shower chair. The caregiver can then easily pick up patients feet and gently rotate chair as the feet are elevated over the bathtub wall, or shower curb and placed in bottom of the bathtub or on the floor of the shower.

When the swivel bath shower chair is rotated so that the patient's feet are in the tube there is sufficient space between the tub wall and the chair to close the shower curtain which keeps water from getting on the bathroom floor.

When a patient has finished showering the caregiver can gently and easily lift the patient's feet and rotate swivel bath shower chair so patient's feet come over the bathtub wall, or over the shower curb, then place patient's feet on the floor outside of the tub or shower. A patient can then be transferred to a wheelchair or walk away if not severely handicapped.

The seat of the swivel bath shower chair has an oval hygiene access to make it possible to easily shower or wash parts of the body the patient is sitting on.

The swivel bath shower chair having two main parts, a base with a pedestal connected to the center of four horizontal legs which are connected at the center and rising perpendicular to a height that allows the chair seat to clear the top of the bathtub wall when the seat is rotated. The pedestal can be smooth or threaded on the inside bore. The chair assembly with the shaft that fits inside pedestal is made to fit the smooth bore or the threaded bore with enough clearance to rotate easily.

The advantages of smooth bore and shaft with bushings to adjust height.

1. Cheaper to manufacture.
2. Easier to separate base and seat assembly if needed for handling and storage.

The advantages of threaded bore and shaft are.

1. The height of the chair seat can be adjusted by rotating the chair seat.
2. The complete chair can be picked up by grasping the chair seat and lifting.

The swivel bath shower chair is to be made to provide comfort, stability and safety for those using it.

The swivel bath shower makes it possible for people with the following conditions to safely and easily be helped into and out of the bathtub or shower.

1. Those who are physically impaired.
2. Those who are handicapped.
3. Those who just have a fear of falling when stepping over the bathtub wall or the shower curb.

Many people who require assistance when using shower or bath chairs, benches or stools may find that using the swivel bath shower chair makes it so easy and safe to get into and out of the bathtub or shower that they can do it without assistance from a caregiver, easily and safely.

It is so easy and simple to rotate the seat of the swivel bath shower chair so the front of the seat extends out over the inside edge of the bathtub wall, or the shower curb, then turn with their back toward the chair, and while holding the chair arms, sit in the chair. When comfortably seated they rotated the chair while lifting one foot at a time over the bathtub wall or shower curb. The process is reversed when the shower is completed.

Caregivers will appreciate the swivel bath shower chair because it eliminates the heavy lifting associated with helping a handicapped patient step over the bathtub wall or shower curb. It eliminates the heavy lifting and strain associated with lifting and scooting a patient across a shower bench in the bathtub or shower. It also eliminates the possibility of tearing the fragile skin of patients when dragging or scooting across a bath or shower bench. A patient's skin becomes fragile because of age, contact with wet diapers and taking certain medications. The present invention also removes the fear of falling while stepping over the bathtub wall or the shower curb.

There are a number of shower chairs, stools and benches on the market but none we have found make it easy and safe for a handicapped person to get into and out of a bathtub or shower. It is a strenuous task for a caregiver, using existing chairs, stools and benches, to assist a handicapped person into a bathtub or shower.

In one type of commercial bench, the handicapped person's legs must be lifted over the bathtub wall when the person must scoot or be lifted into the bathtub. When scooting across the bench there is danger of tearing the fragile skin of the buttock. The caregiver must lift the patient if they are not able to scoot.

In another type of commercial device, a transfer bench with a commode opening and an opening in the seat for the shower curtain to fit into however the legs supporting the seat do not allow the curtain to hang inside the bathtub in order to keep the water off the floor.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A swivel tub and shower chair system comprising:

a base assembly having a pedestal in a hollow cylindrical configuration with an upper and lower end and with a plurality of radially positioned stabilizing legs having interior ends rigidly coupled to the lower end of the pedestal;

a chair assembly having a seat with an access aperture and with an imperforate floor there beneath, and with a pair of vertical side extensions coupling the floor and the seat thereby forming a front opening and a rear opening, the floor further having a lower post extending downwardly therefrom and being adapted to be received in the upper end of the pedestal of the base assembly, the chair being offset forwardly from the center of the base assembly.

2. The system as set forth in claim 1 and further including a cylindrical bearing fabricated of plastic and positionable upon the upper end of the pedestal and adapted to receive the post to facilitate the rotational movement of the chair assembly with respect to the base assembly.

3. The system as set forth in claim 1 and further including a cylindrical ball bearing race fabricated of stainless steel and positionable upon the upper end of the pedestal and adapted to receive the post to facilitate the rotational movement of the chair assembly with respect to the base assembly, the pedestal and post also being fabricated of stainless steel.

4. The system as set forth in claim 1 and further including a plurality of cylindrical spacers fabricated of plastic and positionable upon the upper end of the pedestal and adapted to receive the post to facilitate elevational height of the chair assembly with respect to the base assembly.

5. The system as set forth in claim 1 and further including screw threads on the post and pedestal.

6. A swivel tub and shower chair system with an oval hygiene access to facilitate the cleaning of a physically handicapped person or invalid comprising, in combination:

a bathing assembly positionable adjacent to a room wall and having a bath tub, the bath tub having a horizontal bottom at its lower extent and an upwardly extending interior wall adapted to abut the room wall and an upwardly extending exterior wall parallel with and laterally spaced with respect to the interior wall, the exterior wall terminating at an upper horizontal edge about 12 inches higher than the horizontal bottom of the bath tub;

a plastic base assembly having a vertically disposed support pedestal in a hollow cylindrical configuration with a diameter of about 2 inches and having an upper end and a lower end, the base assembly further having four radially positioned stabilizing legs in a cross-like configuration 90 degrees from each other, each leg being about 12 inches in length formed in a cylindrical configuration with an interior end rigidly coupled to the exterior of the lower end of the pedestal and a second end receiving a nonskid rubber cap to prevent slippage of the base assembly as well as to prevent marring of the bottom of the tub, the base assembly being adapted to rest flatly on the bottom of the tub with the pedestal and legs being sized such that they fit between the interior and exterior walls of the tub;

a plastic chair assembly having a horizontal seat with an oval hygiene access aperture located there through providing increased access to a bather's private areas to be cleaned, the seat having an upper face, lower face, front edge, rear edge and a pair of side edges there between, the seat further having a contoured back having a top edge and a lower edge, the back having a plurality of radially spaced generally rectangular slots, the chair assembly also having a pair of arm rests coupled between the top edge of the back region and the side edges of the seat region in proximity of the front edge forming a forward portion whereby the front edge extends forwardly past arm rests, the aperture being spaced closer to the front edge of the seat than the rear edge, the chair assembly also having an angled imperforate floor with an upper face and lower face and a pair of vertical side extensions coupling the floor and the seat at their sides, the floor and the seat and the side extensions there by forming a front opening and a rear opening with the front opening beneath the front edge of the seat for venting water, the chair assembly further having a coned region with an enlarged upper end coupled to the lower side of the floor and a lower post extending downwardly from the lower tapered end and being adapted to be received in the upper end of the hollow support pedestal of the base assembly, the chair assembly being offset forwardly from the center of the base assembly so when the chair is rotated, the front edge of the seat extends over the exterior wall of the tub; and a cylindrical bearing positionable upon the upper end of the pedestal and adapted to receive the post to facilitate the rotational movement of the seat with respect to the base assembly.

* * * * *